US008225637B2

(12) United States Patent
Filk et al.

(10) Patent No.: US 8,225,637 B2
(45) Date of Patent: Jul. 24, 2012

(54) GUIDING DEVICE FOR THE CHOCKS OF WORK ROLLS

(75) Inventors: Edgar Filk, Netphen (DE); Heiko Zetzsche, Hilchenbach (DE); Otmar Giesler, Kreuztal (DE); Andreas Berendes, Kirchhundem (DE); Bernd Tiepelmann, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 398 days.

(21) Appl. No.: 12/521,659

(22) PCT Filed: Nov. 27, 2007

(86) PCT No.: PCT/DE2007/002144

§ 371 (c)(1),
(2), (4) Date: Jun. 29, 2009

(87) PCT Pub. No.: WO2008/080376

PCT Pub. Date: Jul. 10, 2008

(65) Prior Publication Data

US 2010/0313622 A1 Dec. 16, 2010

(30) Foreign Application Priority Data

Jan. 3, 2007 (DE) ..... 10 2007 001 322

(51) Int. Cl.
*B21B 31/00* (2006.01)

(52) U.S. Cl. ..... 72/241.8; 72/244

(58) Field of Classification Search ..... 72/241.2, 72/241.4, 241.8, 237–239, 244–246, 248
See application file for complete search history.

(56) References Cited

U.S. PATENT DOCUMENTS

| | | | | |
|---|---|---|---|---|
| 4,770,021 | A * | 9/1988 | Kobayashi et al. | 72/247 |
| 5,638,716 | A * | 6/1997 | Jonen | 72/241.8 |
| 6,748,782 | B1 | 6/2004 | Nakajima et al. | |
| 2002/0023473 | A1 * | 2/2002 | Harako et al. | 72/245 |
| 2005/0056069 | A1 | 3/2005 | Thiel et al. | |

FOREIGN PATENT DOCUMENTS

| | | |
|---|---|---|
| DE | 39 06 618 | 9/1990 |
| EP | 0 768 125 | 4/1997 |
| EP | 1 260 283 | 11/2002 |
| WO | WO 03/033183 | 4/2003 |

* cited by examiner

*Primary Examiner* — Edward Tolan
*Assistant Examiner* — Pradeep C Battula
(74) *Attorney, Agent, or Firm* — Cozen O'Connor

(57) ABSTRACT

A guiding device for the chocks of work rolls of a rolling stand comprising guides arranged fixedly or horizontally movably on the inner sides of the windows of the rolling stand, wherein the upper and lower bending blocks of each side are respectively assigned two guides arranged parallel to each other. Each bending block is assigned one of the guides, while it has a recess for the parallel running guide that extends around said guide, wherein the upper bending block is guided on one of the parallel guides and the lower bending block is guided on the other guide.

6 Claims, 3 Drawing Sheets

GUIDING DEVICE FOR THE CHOCKS OF WORK ROLLS

PRIORITY CLAIM

This is a U.S. national stage of application No. PCT/DE2007/002144, filed on 27 Nov. 2007, which claims Priority to the German Application No.: 10 2007 001 322.3, filed: 3 Jan. 2007; the contents of both being incorporated herein by reference.

BACKGROUND OF THE INVENTION

1. Field of the Invention

The present invention pertains to a guide device for the chocks of work rolls of a rolling stand with guides arranged in a stationary or horizontally movable manner on the inner sides of the windows of the rolling stand, where two guides arranged parallel to each other are assigned to the upper and the lower bending blocks of each side.

2. Prior Art

Examples of these types of guide devices are disclosed in DE 39 06 618 C2 and in EP 768 125 B1.

In DE 39 06 618 C2, holding pieces are provided, each of which holds two pairs of guides, where the bending blocks for the upper and lower chocks are guided on these guides. Guide tubes, bushings, or comparable elements located at the ends of the bending blocks are provided for this guidance. To prevent twisting, each bending block has a guide bore, which is also provided with a guide element.

In the solution known from EP 768 125 B1, rods or cylindrical bars are used as guides instead of tubes.

SUMMARY OF THE INVENTION

The invention is based on the goal of simplifying the guidance of the bending blocks and especially on the goal of avoiding or of significantly reducing the friction which occurs in the other known systems.

This goal is achieved according to one embodiment of the invention by a guide device for the chocks of the work rolls of a rolling stand with guides, that are mounted in either a stationary or horizontally movable manner on the inner sides of the windows of the rolling stand, where two guides, which are arranged parallel to each other, are assigned to the upper and lower bending blocks of each side. The guide device is characterized in that one of the guides is assigned to each bending block, whereas it comprises an opening for the parallel guide, by which opening the parallel guide is enclosed, where the upper bending block is guided on one of the parallel guides, the lower bending block on the other guide.

What is involved here is a system which works like the roll-bending system with bending blocks (guide pieces) known from the past. Different in principle, however, is the way in which the bending blocks are guided. This serves to achieve a significant reduction in the amount of friction in the system.

According to one embodiment of the inventive solution, two guides are provided per guide device, but each bending block comprises only one tube, which holds two antifriction bushings, so that it is this guide which actually provides the guidance. An opening is provided in this first bending block for the second guide. In the case of the, cooperating second bending block, this second lower guide—for which an opening has been provided in the previously mentioned first bending block—then serves as the actual guide, whereas an opening is provided in the second block for the first guide. As a result, only one of the guides of the guide device is used for the guidance of each bending block. In other words a rod in the first block is in a guide in the second block and a rod in the second block is in a guide in the first block.

Bushings can be provided as plain bearings in the bending blocks.

Slide plates can be provided on the front side of the rear bracket to prevent twisting.

The guides can be designed as round guides.

The guides themselves are preferably attached to the rolling stand by means of brackets.

Finally, the guide device can be provided with a horizontal shift system.

BRIEF DESCRIPTION OF THE DRAWINGS

The inventive solution is to be explained in greater detail below by reference to the drawings.

Figure 2:
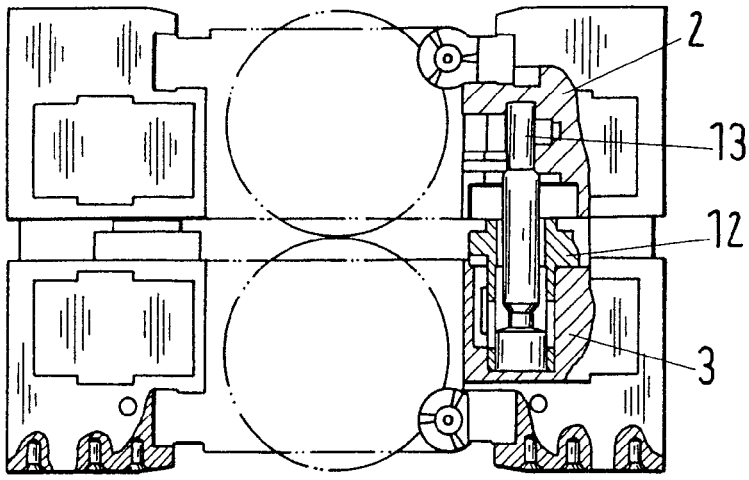
FIG. 2 is a side view in partial cross section.
Figure 1:
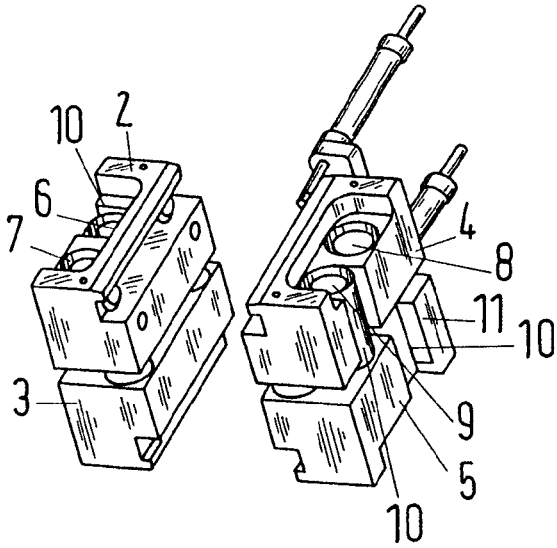
FIG. 1 is a perspective view of the four bending blocks.
Figure 1:
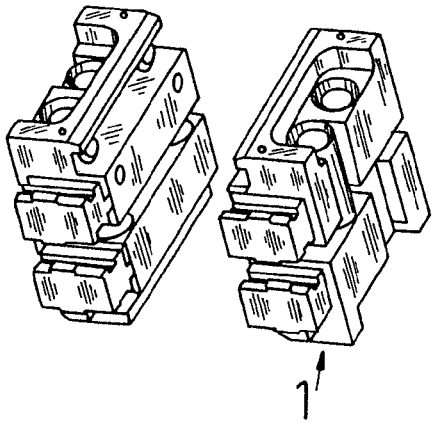

For the sake of simplicity, only the parts which are necessary to understand the invention are shown in the diagrams of the inventive solution.

DETAILED DESCRIPTION OF THE DRAWINGS

The bending system consists of four units 1, the units including bending blocks 2, 3 and 4, 5. A bracket 20, two bending blocks 2, 3 and bracket 20 and two of the bending blocks 2, 3 and 4, 5 are located on each side of a rolling stand.

There are two guide rods 6, 7, and 8, 9 per bracket 20, which is attached to the rolling stand. One of the bending blocks 2, 3, 4, 5 is guided on each of the guide rods 6, 7. The upper bending block 2 on one side is guided on the guide rod 7, whereas the lower bending block 3 on this same side is guided on the guide rod 6. In a corresponding manner, the upper bending block 4 on the other side is guided on the guide 8, and the lower bending block 5 is guided on the guide 9. The one bending block 2, has an opening 10 for the guide rod 6. A corresponding opening in the lower guide block 3 on this side partially encloses the guide rod 7. The same applies to the bending blocks 4, 5 on the other side.

Another special feature contrasting with earlier designs is the length of the guide.

Bushings 11, serving as plain bearings, are seated in each bending block 2, 3, 4, 5, and slide strips 11 are provided on the bracket 20 to prevent twisting.

In the exemplary embodiment shown here, two bending cylinders 12, the heads 13 of which act on the upper bending block 2, are seated in the lower bending block 3. In another embodiment, the design includes a cylinder. The rear bracket 20 preferably serves as a vertical stop for movements of the cylinder.

The contours of the work roll chocks are designed such that the line of action of the bending cylinders is as close as possible to the center of the bearing. This results in a contour different from that of the previous design, but nevertheless the advantages of rapid roll replacement remain preserved.

The bending system can be used in the conventional design or in conjunction with mechanisms for the horizontal shift (HS) of the work rolls. In both cases, the system can be combined with axial displacement mechanisms (CVC, EDC, etc.).

Figure 3:
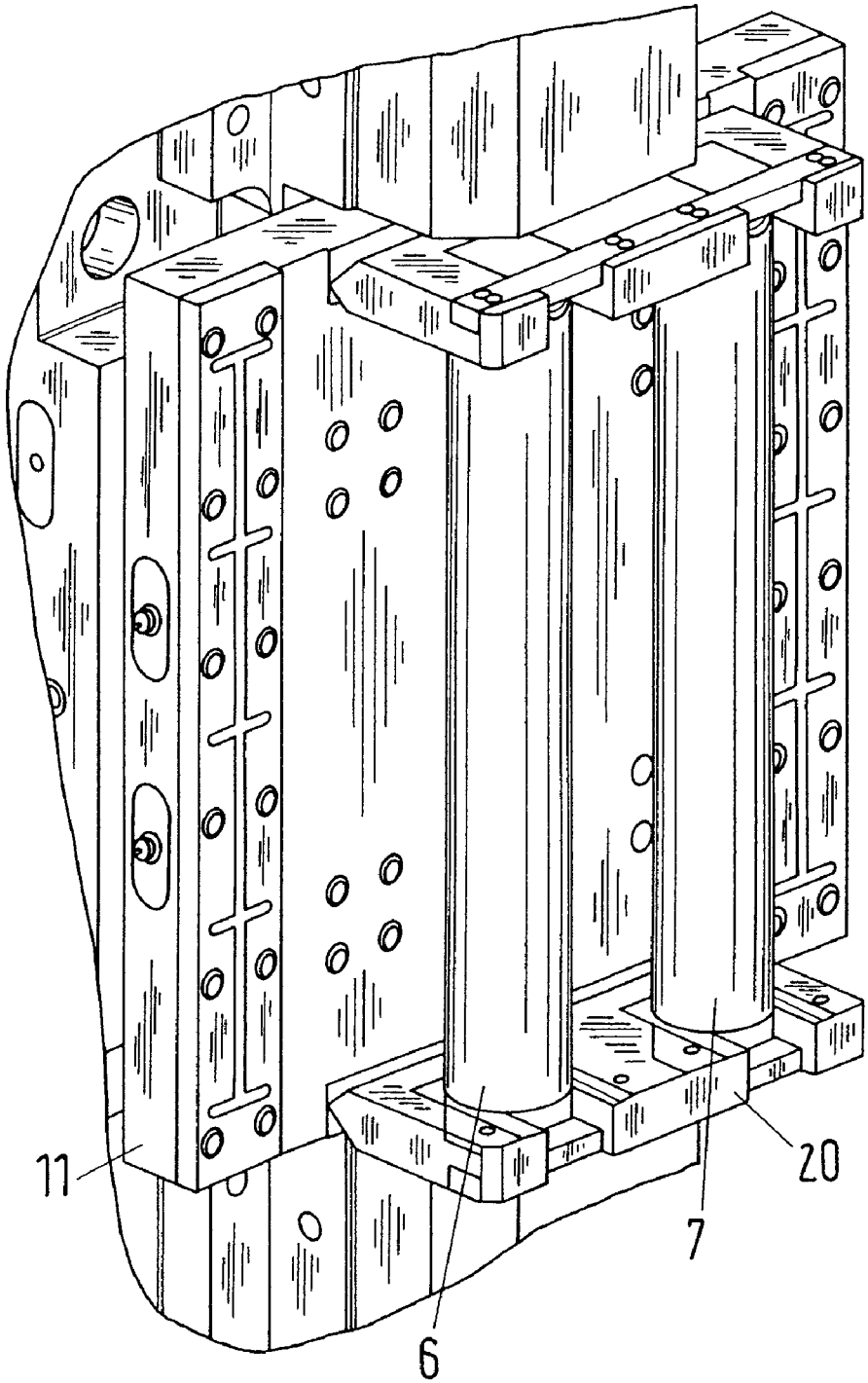
FIG. 3 is a bracket for the guide rods in detail.

FIG. 3 is the bracket 20 for the guide rods 6, 7. In this case rods 6 and 7, are shown on a magnified scale.

Figure 4:
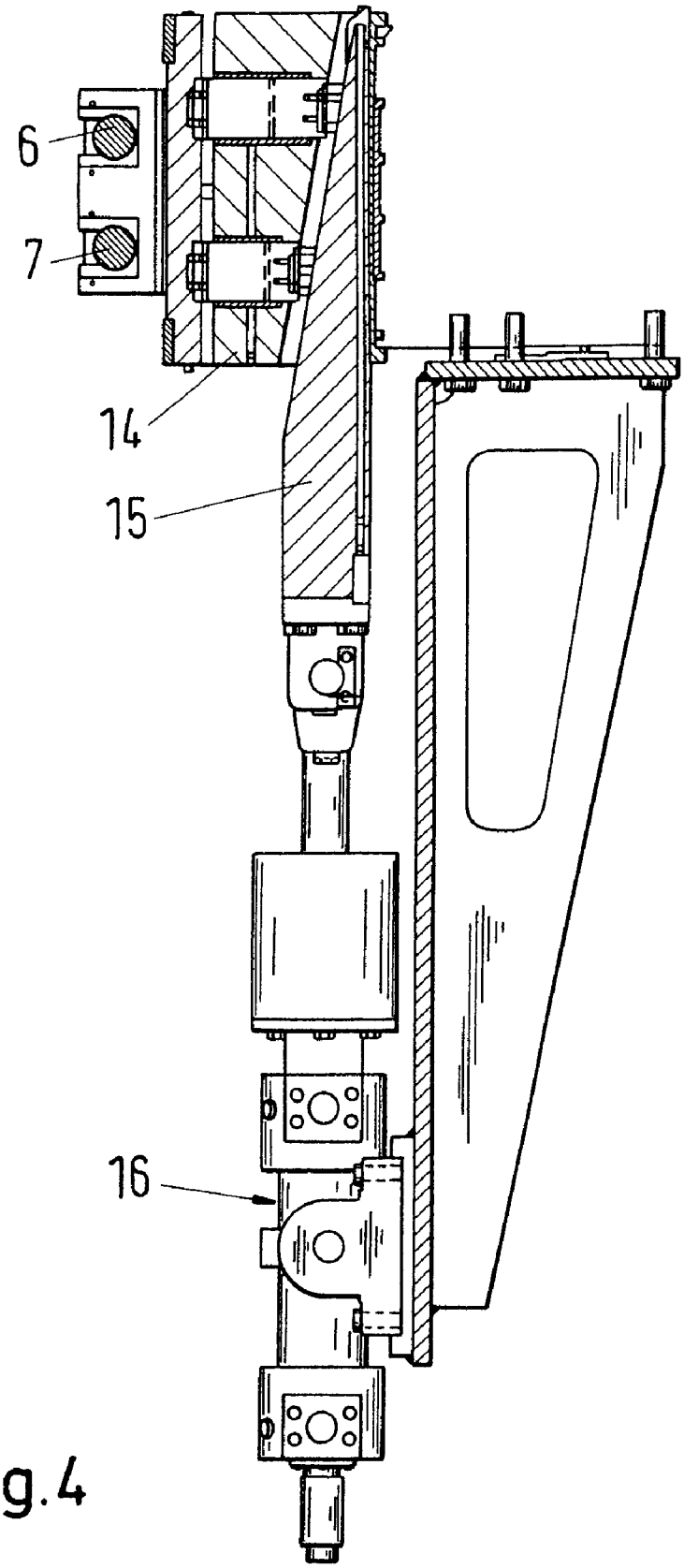
FIG. 4 is an exemplary embodiment of the horizontal shift system.

FIG. 4 is an exemplary embodiment a horizontal shift system based on the example of the guide rods 6 and 7. This is accomplished here by use of wedge surfaces 14 and 15 and a shift drive 16.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A guide device for chocks of work rolls of a rolling stand, the guide device comprising:

an upper bending block having at least one upper guide;

a lower bending block having at least one lower guide;

at least two parallel guide rods are configured in at least one of a stationary or horizontally movable manner on an inner side of the rolling stand, one guide rod of the at least two guide rods being assigned to each of the upper and lower bending blocks, wherein the one guide rod assigned to one of the upper and lower bending blocks is configured to mate with a corresponding guide in the other of the upper and lower bending blocks, whereby the upper bending block is guided on one of the parallel guide rods and the lower bending block is guided on the other of the parallel guide rods, and wherein the upper bending block includes an opening for receiving therethrough the other of the parallel guide rods and the lower bending block includes an opening for receiving therethrough the one of the parallel guide rods.

2. The guide device according to claim 1, wherein at least one bushing is provided as plain bearings in each of the upper and lower bending block guides.

3. The guide device according to claim 1 wherein the guide rods are round guides.

4. The guide device according to claim 1, further comprising a horizontal shift system configured to move the upper and lower bending blocks horizontally.

5. A guide device for chocks of work rolls of a rolling stand, the guide device comprising:

an upper bending block having at least one upper guide;

a lower bending block having at least one lower guide;

at least two parallel guide rods are configured in at least one of a stationary or horizontally movable manner on an inner side of the rolling stand, one guide rod of the at least two guide rods being assigned to each of the upper and lower bending blocks, wherein the one guide rod assigned to one of the upper and lower bending blocks is configured to mate with a corresponding guide in the other of the upper and lower bending blocks, whereby the upper bending block is guided on one of the parallel guide rods and the lower bending block is guided on the other of the parallel guide rods, and a bracket, the two parallel guide rods being mounted on the bracket, and at least one slide plate configured as an antitwist device coupled to a front of the bracket.

6. The guide device according to claim 5, wherein the guide rods are attached to the rolling stand by the bracket.

* * * * *